US005921793A

United States Patent [19]

Phillips

[11] Patent Number: 5,921,793

[45] Date of Patent: Jul. 13, 1999

[54] SELF-TERMINATING COAXIAL CONNECTOR

[75] Inventor: Michael John Phillips, Camp Hill, Pa.

[73] Assignee: The Whitaker Corporation, Wilmington, Del.

[21] Appl. No.: 08/863,755

[22] Filed: May 27, 1997

Related U.S. Application Data

[60] Provisional application No. 60/018,795, May 31, 1996.

[51] Int. Cl.[6] ..... H01R 13/703

[52] U.S. Cl. ..... 439/188; 439/944

[58] Field of Search ..... 439/188, 944

[56] References Cited

U.S. PATENT DOCUMENTS

| | | | |
|---|---|---|---|
| 2,640,118 | 5/1953 | Werner | 200/51.1 |
| 3,467,940 | 9/1969 | Wallo | 339/14 |
| 3,873,785 | 3/1975 | Lieberman | 200/51.1 |
| 4,099,825 | 7/1978 | Jackson | 339/177 |
| 4,952,173 | 8/1990 | Peronnet et al. | 439/583 |
| 4,971,569 | 11/1990 | Gooch et al. | 439/188 |
| 5,030,122 | 7/1991 | Birch et al. | 439/188 |
| 5,076,797 | 12/1991 | Moulton | 439/188 |
| 5,108,300 | 4/1992 | Weber | 439/188 |
| 5,219,297 | 6/1993 | Stein et al. | 439/188 |
| 5,219,299 | 6/1993 | Wang | 439/188 |
| 5,237,293 | 8/1993 | Kan et al. | 333/22 R |
| 5,320,546 | 6/1994 | Weber | 439/188 |
| 5,340,325 | 8/1994 | Pai | 439/188 |
| 5,598,132 | 1/1997 | Stabile | 439/188 |
| 5,632,637 | 5/1997 | Diener | 439/188 |
| 5,730,612 | 3/1998 | Tatsuzuki | 439/188 |

FOREIGN PATENT DOCUMENTS

| | | | |
|---|---|---|---|
| 154199 | 9/1985 | European Pat. Off. . | |
| 0 685 911 A1 | 12/1995 | European Pat. Off. | H01R 17/12 |
| 2707250 | 8/1978 | Germany . | |

*Primary Examiner*—Neil Abrams
*Attorney, Agent, or Firm*—Salvatore Anastasi

[57] ABSTRACT

A coaxial connector 2 is provided having a central insulator 6 which surrounds the signal contact, an impedance element 18 such as a resistor disposed around the outside of the central insulator 6 which is in contact with the outer conductive housing 4 on one end and a spring 10 on the other end. The spring 10 extends around and along the outside of the central insulator 6 and is in contact with a switch contact 14 which is also disposed around the central insulator. The switch contact 18 is biased towards, and is normally in contact with the center conductor 12. The switch is actuated by an actuator 16 which is placed around the center conductor 12 and is movable in cooperation with the mating connector 90 to open or separate the switch contact 14 from the center conductor 12.

12 Claims, 4 Drawing Sheets

SELF-TERMINATING COAXIAL CONNECTOR

This is related to Provisional Application Ser. No. 60/018,795 filed May 31, 1996 and claims the benefit thereof under 35 U.S.C. §119(e)

FIELD OF INVENTION

This invention relates to the general art of electrical connectors and more specifically to a selfterminating coaxial connector.

BACKGROUND OF THE INVENTION

In high-frequency applications, coaxial connectors are typically used to connect either devices or transmission lines to other transmission lines. The coaxial cable used for the transmission lines in these applications have a characteristic impedance which is defined as the impedance that would be presented at the input terminals of a transmission line that is theoretically infinitely long. An open circuit anywhere along the transmission line represents an end of the transmission line which will reflect the transmitted signal back towards the input terminals or the source.

A matching circuit is typically employed to solve The reflection problem. The matching circuit typically consists of a resistance equal to that of the characteristic impedance of the cable which is placed at the cable end between the signal and the shield. For example, a typical characteristic impedance for a coaxial line is 50 Ohms; therefore, a 50 Ohm resistor can be used for the matching circuit and is connected between the signal and the shield at the end of the coaxial transmission line.

Since an unmated coaxial connector represents the end of the transmission line in a circuit, a termination plug containing the matching circuit is typically connected to the unmated coaxial connector. The termination plug serves to connect a resistance equal to the characteristic impedance of the cable between the signal contact and the shield of the open unmated coaxial connector.

This presents a problem in complex circuits having many coaxial connectors which may be either in the mated or unmated condition during operation. All of the unmated coaxial connectors would require a termination plug to be connected thereto in order to avoid any reflection of the high frequency signals back towards a source. If one unmated connector is overlooked or if the termination plug is lost, undesired back reflection will result.

Known methods of addressing this problem include placing a normally closed switch into the unmated coaxial connector which will close a circuit between the signal contact and the shield having a resistor equal in resistance to the characteristic impedance of the cable. Weber teaches such connectors in U.S. Pat. Nos. 5,108,300 and 5,320,546. These patents show a pair of switch contacts, one of which has an impedance element connected between one of its ends and the outer shell or shield of the connector. The other switch contact is connected to the signal contact on a printed circuit board. The switch is normally closed such that in the unmated condition the signal contact is connected to the outer shell of the connector through the impedance element. Upon mating, the signal contact is separated from the other switch contact and is then connected to the signal contact of the mating connector.

There are several problems with this design; the first being that in high-frequency applications it is desirable to maintain a coaxial relationship between the signal and the shield contacts when the connector is in the unmated condition. It will be noted here that the switch contacts are not in a coaxial orientation, instead they are simply adjacent to each other. This has an adverse effect on the electrical performance of the connector when operated at high frequency. Wherever the coaxial orientation is not maintained, there will be a change in impedance in that area. The impedance will be lower in the coaxial areas than in the switching area. As a signal passes through the connector, there will be reflections at every transition between the higher and lower impedance areas results in increased signal losses through the connector. Also since the switching action relies on a lateral motion, there is a tendency for the biased switch contact to apply a normal force to the center contact of the mating connector. This normal force may be sufficient to bring the center contact of the mating connector in contact with the switch contact which is connected to the shell thus causing a short circuit.

U.S. Pat. No. 5,237,293 discloses a self-terminating coaxial cable connector having a switchable impedance equal to the characteristic impedance of a coaxial connector. The switch of this connector, like the Weber connectors, operates by a lateral force exerted on the switch contact in order to open the switch. The switch contact here is actuated by a housing edge surface of the mating connector. This edge surface may be damaged when the mating connector is in the unmated condition which would adversely affect actuation of the switch upon mating. The switch contact also exerts lateral forces on the center contact much like the Weber patents which could possibly affect proper centering location of the center contact. The problem with all of these connectors is that they exert a lateral force on the center contact of the connectors. Additionally, they typically have a ground path length that is longer than necessary between the signal contact and the connection to the shield through the impedance element. This adversely affects the electrical performance of the coaxial connector.

SUMMARY OF THE INVENTION

It is therefore an object of this invention to provide a self-terminating switching connector which does not exert a lateral force on the center contact. An additional object of the invention is to provide a self-terminating coaxial connector which minimizes the ground path length between the switch contact and the connection to the shield.

The objects of this invention are achieved by providing a coaxial connector having a central insulator which surrounds the signal contact at the rear end of the connector, an impedance element disposed around the outside of the central insulator which is in contact with the outer conductive housing on one end and a spring on the other end. The spring extends around and along the outside of the central insulator and is in contact with a switch contact which is also disposed around the central insulator near the mating end. The switch contact is biased towards, and is normally in contact with, the center conductor when the connector is in the unmated condition. The switch is actuated by an actuator which is placed around the center conductor and is movable in cooperation with the mating connector to open or separate the switch contact from the center conductor.

BRIEF DESCRIPTION OF THE DRAWINGS

The invention will now be described by way of example with reference to the accompanying figures of which.

DETAILED DESCRIPTION OF THE INVENTION

Figure 1:
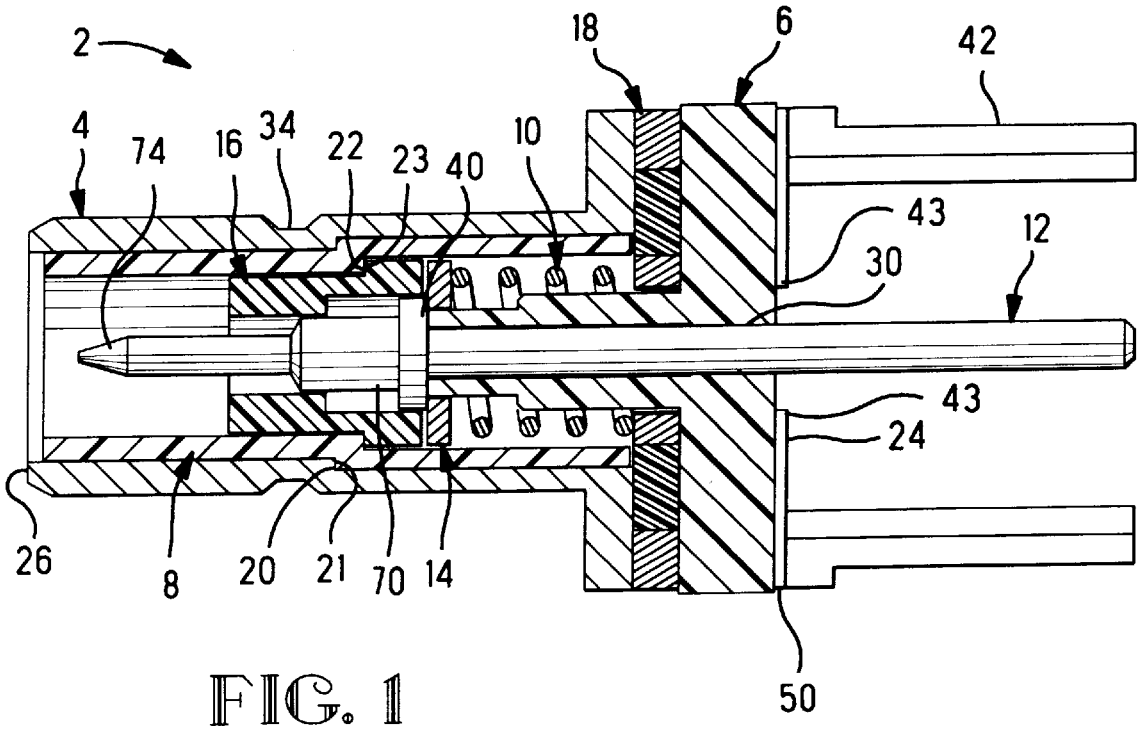
FIG. 1 shows a cross sectional view of a self terminating coaxial connector according to the present invention.

Referring to FIG. 1, the connector 2 will now be described in general. A conductive housing 4 is provided for mounting to a printed circuit board (not shown). A male connector 2 is shown here, but it should be understood that these concepts can also be applied to a female version of this connector for mounting to a printed circuit board. The housing 4 is generally cylindrically shaped having a main cavity 46 and a base section 50 at the mounting surface 24. An annular shoulder 20 is provided on the inner surface of the conductive housing 4. The dielectric sleeve 8 having a complementary annular shoulder 21 is fit into and along the inner diameter of the conductive housing 4 such that the complementary annular shoulder 21 abuts the annular shoulder 20 of the housing 4. An actuator 16 surrounds the center contact 12 near the mating face 26 and abuts the dielectric sleeve 8 at a shoulder 22. A conductive switch contact ring 14 is slidably disposed around a central insulator 6 and is captured between a coil spring 10 and a center contact 12. The central insulator 6 is disposed around the center contact 12 which passes through a passage 30 in the center of the central insulator 6. The coil spring 10 surrounds the central insulator 6 and serves to bias the switch contact ring 14 toward the mating face 26 and the actuator 16. An impedance element 18, such as a resistor, is in electrical contact with the spring 10 and the switch contact ring 14. The impedance element 18 electrically connects the spring 10 to the conductive housing 4.

Figure 2:
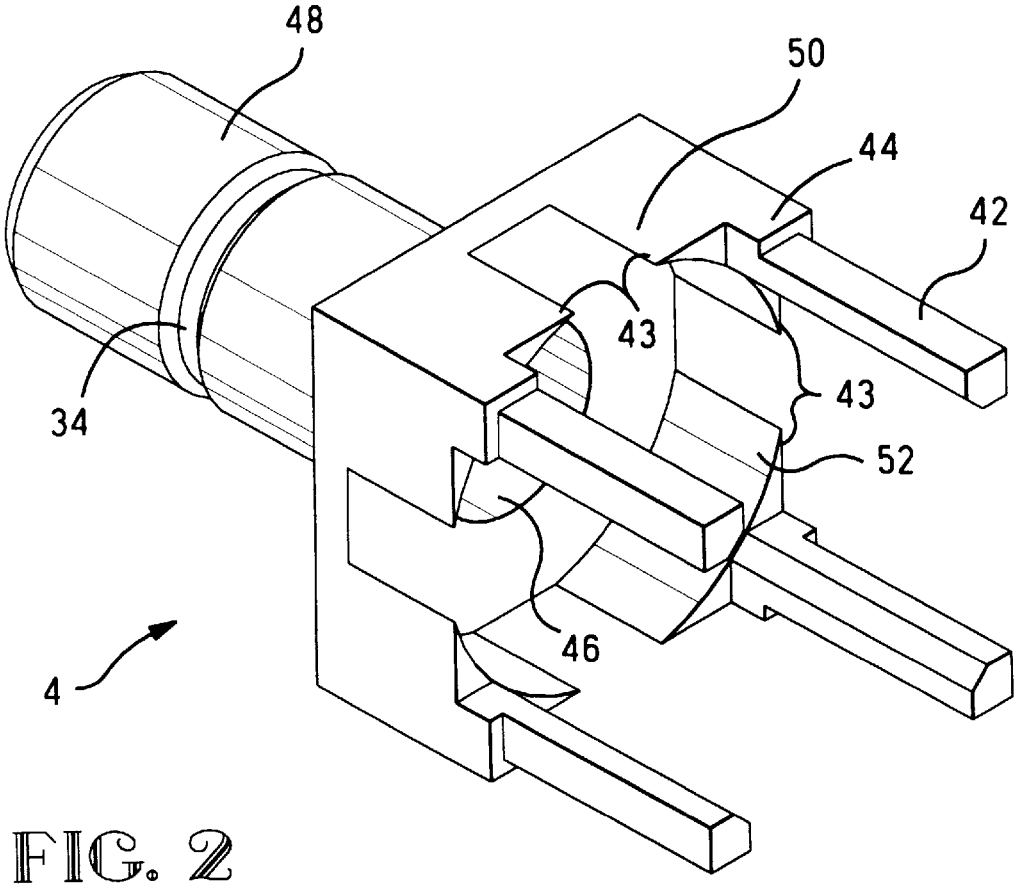
FIG. 2 shows a three dimensional view of the housing used in the connector of FIG. 1.

Each of the major components will now be described in greater detail. Beginning with the conductive housing 4 and referring to FIGS. 2 and 3, this housing is generally cylindrically shaped and has a main cavity 46. The side walls 48 of the main cavity 46 are profiled to have an annular locking shoulder 38 on their inner surface, and an annular groove 34 on its outer surface. The main cavity 46 extends from the mating face 26 toward the base section 50. The base section 50 is generally rectangularly shaped on its outside surface but has a circular component receiving area 52 which is defined by the inner walls thereof and is in communication with the main cavity 46 of the housing 4. Standoff sections 44 extend from the bottom of the base section 50 and posts 42 extend also from the bottom of the base section 50 beyond the standoff sections 44.

Figure 3:
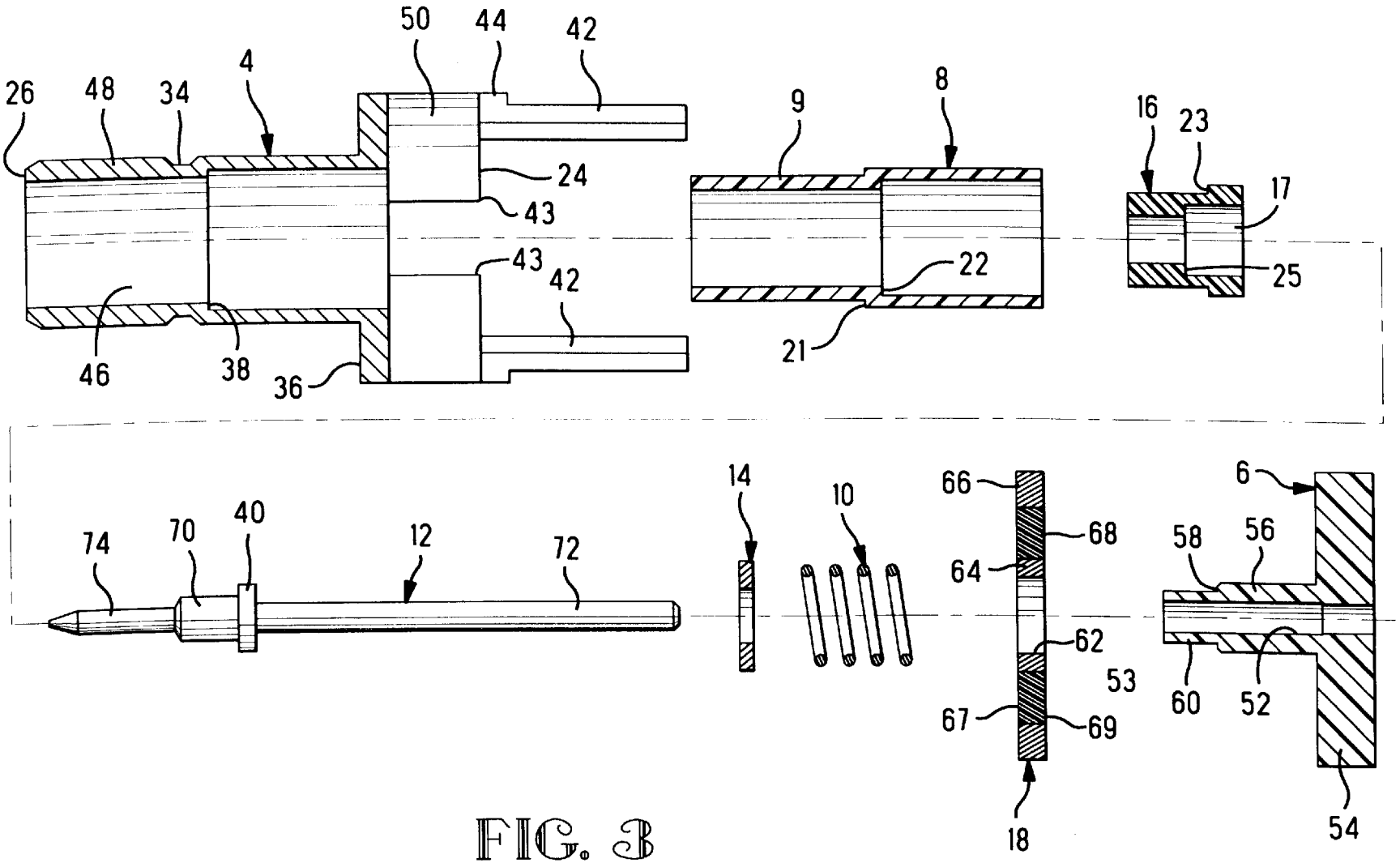
FIG. 3 shows an exploded cross sectional view of the connector of FIG. 1.

The dielectric sleeve 8 will now be described in greater detail with reference to FIG. 3. The sleeve 8 is formed from an insulative material and is generally cylindrically shaped having sidewalls 9. The sleeve 8 is designed to have a smaller diameter towards the mating face 26 and the larger diameter towards the board mounting end 24 with a step transition therebetween. The step transition is comprised of two annular shoulders 21,22. The complementary annular shoulder 21 is profiled to cooperate with an annular shoulder 20 on the housing 4. The inner annular shoulder 22 is profiled to cooperate with a complementary annular shoulder 23 on the actuator 16. The outer shoulder 21 serves to maintain the dielectric sleeve 8 in the housing and the inner shoulder 22 serves as a stop for maintaining the actuator 16 in position when the switch is closed.

The actuator 16 will now be described in greater detail again with reference to FIG. 3. The actuator 16 like the dielectric sleeve 8 is also generally cylindrically shaped and has a step transition section from a smaller diameter toward the mating face 26 to a larger diameter toward the board mounting end 24. The transition consists of a complementary annular shoulder 23 which is profiled to cooperate with the inner shoulder 22 of the dielectric sleeve 8. This cooperation serves as a stop to maintain the actuator 16 in the biased closed position. The actuator 16 also has a passageway 17 for receiving the center contact 12. The passageway 17 is profiled such that an inner shoulder 25 cooperates with an annular projection 40 on the center contact 12 to stop the actuator 16 at its open circuit position when the spring 10 is compressed.

The central insulator 6 will now be discussed in greater detail again with reference to FIG. 3. The central insulator 6 is also generally cylindrically shaped and has a transition from a larger diameter towards the board mounting end 24 to a smaller diameter towards the mating face 26. The base section 54 is of a larger diameter than the spring receiving section 56. A passageway 52 passes through the center of the central insulator 6 and through both the base section 54 and the spring receiving section 56. A switch contact receiving section 60 which is smaller in diameter than the spring receiving section extends from the spring receiving section 56 toward the mating face 26. An annular shoulder 58 which acts as a stop for the switch ring 14 is disposed between the sections 56,60. The central insulator 6 is profiled to fit into the main cavity 46 of the housing 4 and serves to enclose the spring 10, the switch contact ring 14, and the impedance element 18 in the housing 4.

Figure 4:
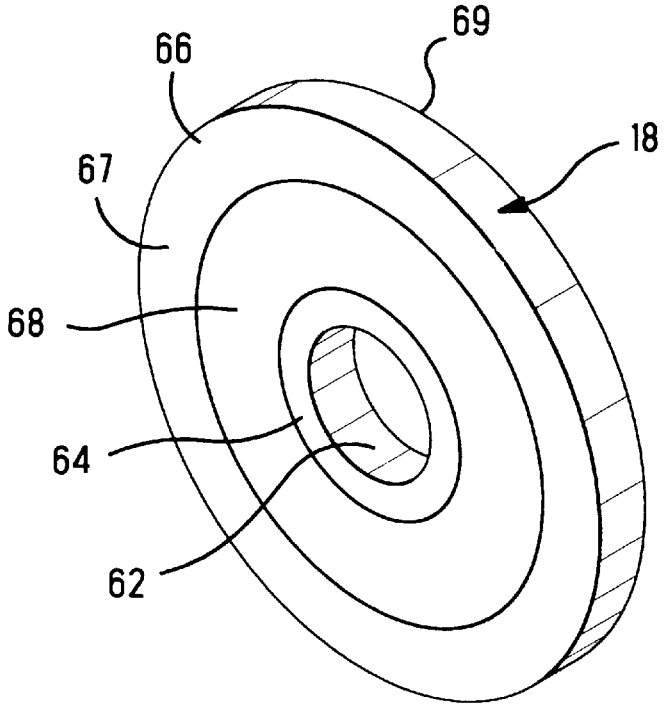
FIG. 4 shows a three dimensional view of an impedance element used in the connector of FIG. 1.

The impedance element 18 will now be described in greater detail with reference to FIGS. 3 and 4. The impedance element 18 is generally disk shaped having an opening 62 through which the central insulator 6 passes. A first inner contact section 64 disposed about the opening 62 along the top and bottom surfaces 67,69 and an outer contact section 66 is disposed about the outer periphery of the disc on both the top and bottom surfaces 67,69. Between the two contact sections 64,66 is the impedance component 68 housed in insulative material on the top and bottom surfaces 67,69.

The coil spring 10 is disposed around the spring receiving section 56 of the central insulator 6. It is in electrical contact with the contact section 64 of the impedance element 18 and with the switch ring contact 14. The coil spring 10 biases the switch ring contact 14 towards the annular projection 40 of the center contact 12.

The center contact 12 will now be described in greater detail with reference to FIG. 3. The center contact 12 is also generally cylindrically shaped and consists of a tail section 72, an annular projection 40, an actuator receiving section 70, and a pin contact section 74. The tail section 72 is profiled to fit into the passageway 52 of the central insulator 6 and the annular projection 40 abuts the end surface 53 of the central insulator 6. The actuator receiving section 70 is profiled to fit into the larger portion of the passageway 17 of the actuator 16. The annular projection 40 also cooperates with the inner shoulder 25 to act as a stop for the actuator 16. The pin section 74 is designed to mate with the complementary connector which is inserted from the mating end into the housing 4.

The conductive switch contact ring 14 simply consists of a conductive disk having a passageway through the center for fitting over the switch contact receiving section 60 of the central insulator 6. This disk is simply shaped like a washer.

Figure 5:
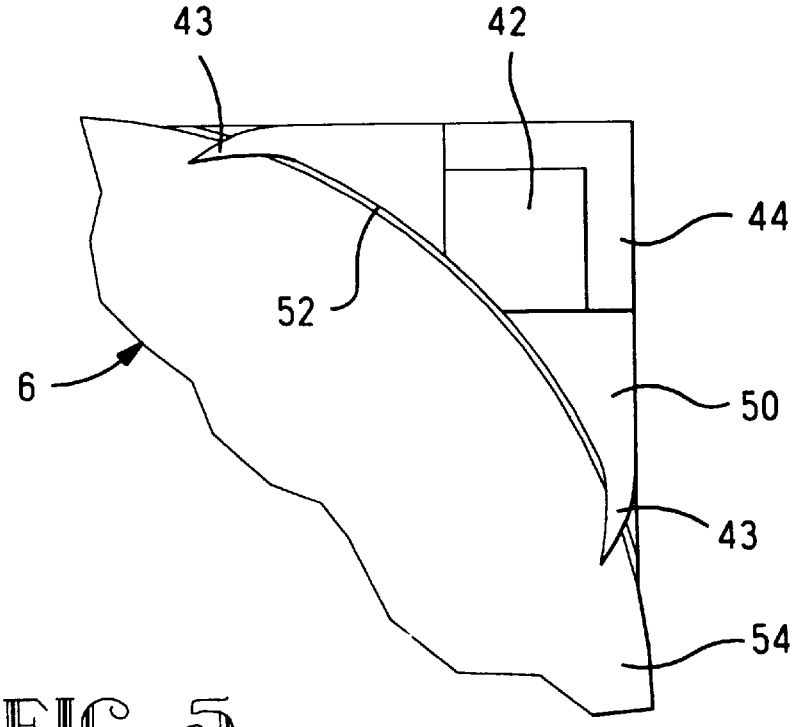
FIG. 5 shows a detail end view of a portion of the housing of FIG. 1.

Assembly of the connector 2 will now be described with reference to FIGS. 3 and 5. First the insulator sleeve 8 is inserted into the housing 4 from the board mounting end 24 such that the locking shoulder 38 cooperates with the outer shoulder 21 to fix the sleeve 8 in the housing 4. The actuator 16 is then placed into the insulator sleeve 8 from the board mounting end 24 such that the inner shoulder 22 engages the complementary annular shoulder 23. The center contact 12 is then inserted into the actuator 16 through the passageway 17 such that the contact tips 74 extends through the passageway towards the mating face 26 of the connector 2. The annular projection 40 engages the inner shoulder 25 to maintain the center contact 12 in position.

The central insulator 6, the impedance element 18, the coil spring 10, and the conductive switch contact ring 14 may then be subassembled. The impedance element 18 is first placed over the central insulator 6 such that the spring receiving section 56 passes through the opening 62. The coil spring 10 is then over the spring receiving section 56 such that the spring 10 is an electrical contact with the inner contact section 64 of the impedance element 18. The switch contact ring 14 is then placed over the central insulator at the switch contact receiving section 60 such that it is an electrical contact with the spring 10. This entire subassembly is then inserted into the housing 4 from the board mounting end 24 such that the switch contact ring 14 abuts the annular projection 40 and the tail section 72 passes through the switch contact ring 14, the spring 10, the impedance element 18, and the central insulator 6. As best shown in FIG. 5, retention tips 43 are then cut and rolled inward to engage the central insulator 6 at the board mounting end 24. While only one corner is illustrated in FIG. 5, it should be understood that a similar pair of retention tips 43 are cut and bent similarly at each of the four corners. These retention tips serve to capture all of the components in the housing 4.

Operation of the switching mechanism will now be described in greater detail with reference to FIG. 1 and 6. As shown in FIG. 1, the connector 2 is in the unmated condition. The coil spring 10 exerts a biasing force on the switch contact ring 14 which urges it towards the mating face 24 such that it is an electrical contact with the annular projection 40 of the center contact 12. Therefore, a circuit is completed from the pin contact 74, to the annular projection 40, to the switch contact ring 14, through the coil spring 10, through the impedance element 18, to the conductive housing 4 which is ultimately connected to a ground circuit on a printed circuit board via posts 42. This connector 2 is self-terminated in this condition because the impedance element 18 is connected between the center contact 12 and the shield or housing 4.

Figure 6:
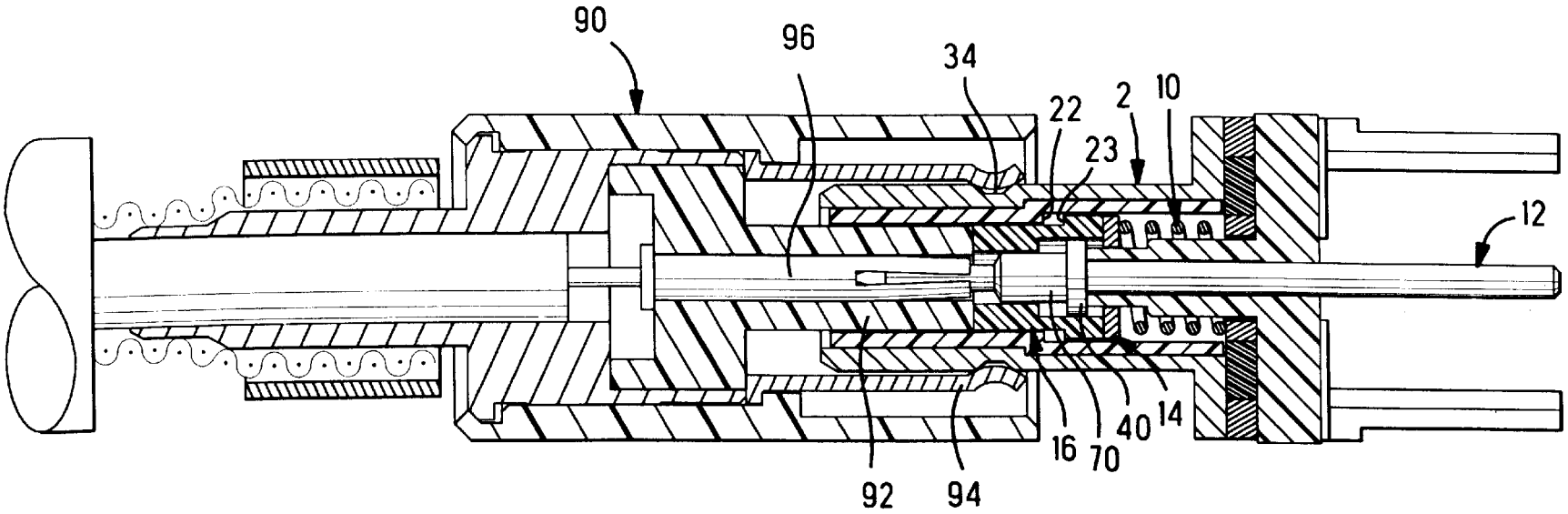
FIG. 6 shows a cross sectional view of the connector of FIG. 1 mated with a complementary connector.

Referring to FIG. 6, the connector 2 is shown in the mated condition. As the complementary connector 90 is mated with the board mounted connector 2, the central dielectric 92 of the mating connector 90 cooperates with the actuator 16 in order to urge the switch contact ring 14 away from the annular projection 40 of the center contact 12. In this condition, since the switch contact ring 14 is urged away from the annular projection 40, the circuit between the center contact 12 and the housing 4 is now open between the switch contact ring 14 and the annular projection 40 of the center contact 12. The mating connector 90 is held in this position through a retention clip 94 which cooperates with the annular groove 34.

It should also be noted here that the switching connector 2 is shown as having a male center pin and the mating connector 90 is shown as having a female center pin 96. It is possible to reverse this arrangement such that the female connector 90 is mounted to the circuit board and has a switching arrangement as described herein.

An advantage of this connector is that it provides a simple switching mechanism for self-termination of a coaxial connector thus eliminating the need for a termination plug to be connected to the connector when the connector is not in use or in the unmated condition.

Another advantage to this switching self-terminating connector is that a coaxial arrangement between the impedance element, the switching contact, and the center conductor is maintained throughout the entire length of the connector. This maintains the impedance virtually constant through the connector and reduces signal reflections and losses. Additionally, the ground path length between the switch-point and the connection to ground through the impedance is minimized thus improving electrical performance in high speed signal applications.

I claim:

1. An electrical connector having a center contact, a conductive housing, and an impedance switchably connected between the center contact and the conductive housing, the connector comprising:

an actuator which is cooperable with a mating connector;

a switch contact being engagable with the actuator, surrounding the center contact and being partially insulated therefrom;

a coil spring surrounding the center contact, electrically contacting the switch contact at a first end and biasing the switch contact toward a switch point on the center contact; and, an impedance, having an inner contact and an outer contact, the impedance surrounding the center contact, and being electrically insulated therefrom, the inner contact being in electrical contact with a second end of the coil spring and the outer contact being in electrical contact with the housing;

whereby the switch contact is biased toward the center contact to close a circuit from the housing through the impedance to the center contact when the connector is in an unmated condition; and the actuator is cooperable with a mating connector to urge the switch contact away from the switch point of the center contact opening the circuit when the connector is in a mated condition.

2. The electrical connector as recited in claim 1 wherein the center contact further comprises a shoulder defining the switch point being in electrical contact with the switch contact when the connector is in the unmated condition.

3. The electrical connector as recited in claim 2 wherein the switch contact is disk shaped having an opening in its center, and is biased to engage the shoulder when the connector is in the unmated condition.

4. The electrical connector as recited in claim 1 wherein the impedance is a resistor.

5. An electrical connector having a center contact, a conductive housing, and an impedance element which is switchably electrically connected between the conductive housing and the center contacts, the electrical connector comprising:

a switch being normally closed and actuatable by an unmating action with a complementary connector such that upon unmating from the complementary connector, a circuit is completed from the center contact through the impedance element to the conductive housing, said circuit being spaced from and surrounding the center contact in a coaxial orientation through the electrical connector from the center contact to the conductive housing.

6. The electrical connector as recited in claim 5 wherein the normally closed switch comprises a switch contact and a shoulder of the center contact.

7. The electrical connector as recited in claim 6 wherein the switch contact is disk shaped having an opening in its center, and is biased to engage the shoulder when the connector is in the unmated condition.

8. The electrical connector as recited in claim 7 wherein the switch contact is biased toward the shoulder by a conductive coil spring which engages both the switch contact and the impedance element and is disposed around the center contact.

9. The electrical connector as recited in claim 8 wherein an insulator is disposed between the coil spring and the center contact.

10. The electrical connector as recited in claim 5 wherein the impedance element is generally resistive.

11. The electrical connector as recited in claim 5 wherein the impedance element is disk shaped having an opening in the center surrounded by a first inner contact section, the first inner contact section being surrounded by an impedance component, and the impedance component being surrounded by an outer contact section.

12. The electrical connector as recited in claim 11 wherein the inner contact of the impedance element is in contact with an end of the spring opposite the switch contact.

* * * * *